US005895342A

United States Patent [19]

Solland

[11] Patent Number: 5,895,342

[45] Date of Patent: Apr. 13, 1999

[54] PORTABLE EXERCISE DEVICE

[76] Inventor: Kurt M. Solland, P.O. Box 2078, Manhattan Beach, Calif. 90267-2078

[21] Appl. No.: 08/946,042

[22] Filed: Oct. 5, 1997

Related U.S. Application Data

[60] Provisional application No. 60/035,310, Jan. 13, 1997.

[51] Int. Cl.[6] ..... A63B 21/068

[52] U.S. Cl. ..... 482/96; 482/95

[58] Field of Search ..... 482/95, 96

[56] References Cited

U.S. PATENT DOCUMENTS

| | | | |
|---|---|---|---|
| 231,869 | 8/1880 | Tuttle | 482/96 |
| 232,217 | 9/1880 | Tuttle . | |
| 248,121 | 10/1881 | Tuttle . | |
| 2,472,391 | 6/1949 | Albizu . | |
| 2,733,922 | 2/1956 | Diego . | |
| 2,783,045 | 2/1957 | Bosch . | |
| 2,920,890 | 1/1960 | Nawara . | |
| 3,219,341 | 11/1965 | Weinstein . | |
| 3,380,737 | 4/1968 | Elia et al. . | |
| 3,446,503 | 5/1969 | Lawton . | |
| 3,984,101 | 10/1976 | Garza . | |
| 4,211,403 | 7/1980 | Coffaro et al. . | |
| 4,248,420 | 2/1981 | Hayes . | |
| 4,252,314 | 2/1981 | Ceppo . | |
| 4,272,074 | 6/1981 | Sferle . | |
| 4,383,684 | 5/1983 | Schliep . | |
| 4,468,025 | 8/1984 | Sferle . | |
| 4,489,936 | 12/1984 | Dal Monte . | |
| 4,632,390 | 12/1986 | Richey . | |
| 4,725,057 | 2/1988 | Shifferaw . | |
| 4,743,010 | 5/1988 | Geraci . | |
| 4,746,114 | 5/1988 | Grider . | |
| 4,757,991 | 7/1988 | Maag . | |
| 4,949,958 | 8/1990 | Richey . | |
| 5,346,447 | 9/1994 | Stearns . | |
| 5,470,295 | 11/1995 | Wang . | |
| 5,507,709 | 4/1996 | Wu . | |
| 5,512,027 | 4/1996 | Chen . | |
| 5,569,130 | 10/1996 | Wang et al. . | |

OTHER PUBLICATIONS

The Shelburne Company Catalog Winter/Holiday '83 cover page and page showing Exercise Home Gym, published 1983.

*Primary Examiner*—Lynne A. Reichard

*Attorney, Agent, or Firm*—Westman, Champlin & Kelly

[57] ABSTRACT

A lightweight and portable exercise device has a base frame that folds quickly and easily between a highly compact stored configuration and a deployed configuration ready for use. The exercise device include a compact support platform connected by pivot links to the base frame, and a pivoting lift bar is coupled to the base frame and will bear against the support platform to permit lifting of the support platform as the pivot links pivot with a variably selected mechanical moment arm. In use, a person stands on the support platform and lifts his or her own weight by pulling upwardly on an outer end of the lift bar. The lift force required for a given weight on the support platform is controlled by the selected lift bar moment arm. Lift straps connected to the lift bar include easily grasped handles that are adjustable in length to accommodate persons of different size and further to permit the device to be used for different exercise routines.

18 Claims, 6 Drawing Sheets

16
18
23
26
36
34
28
32
29
28
26
22
22
23
24
28
23A 20
18B
50
18
18A
16
26
26
22
24
22

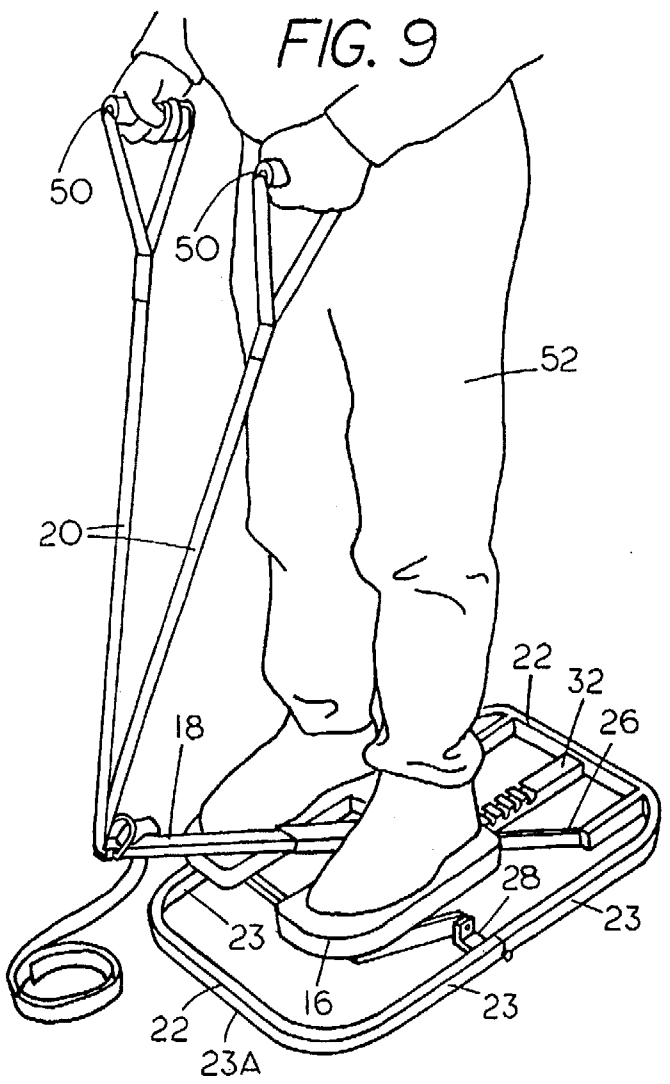
FIG. 9
FIG. 8
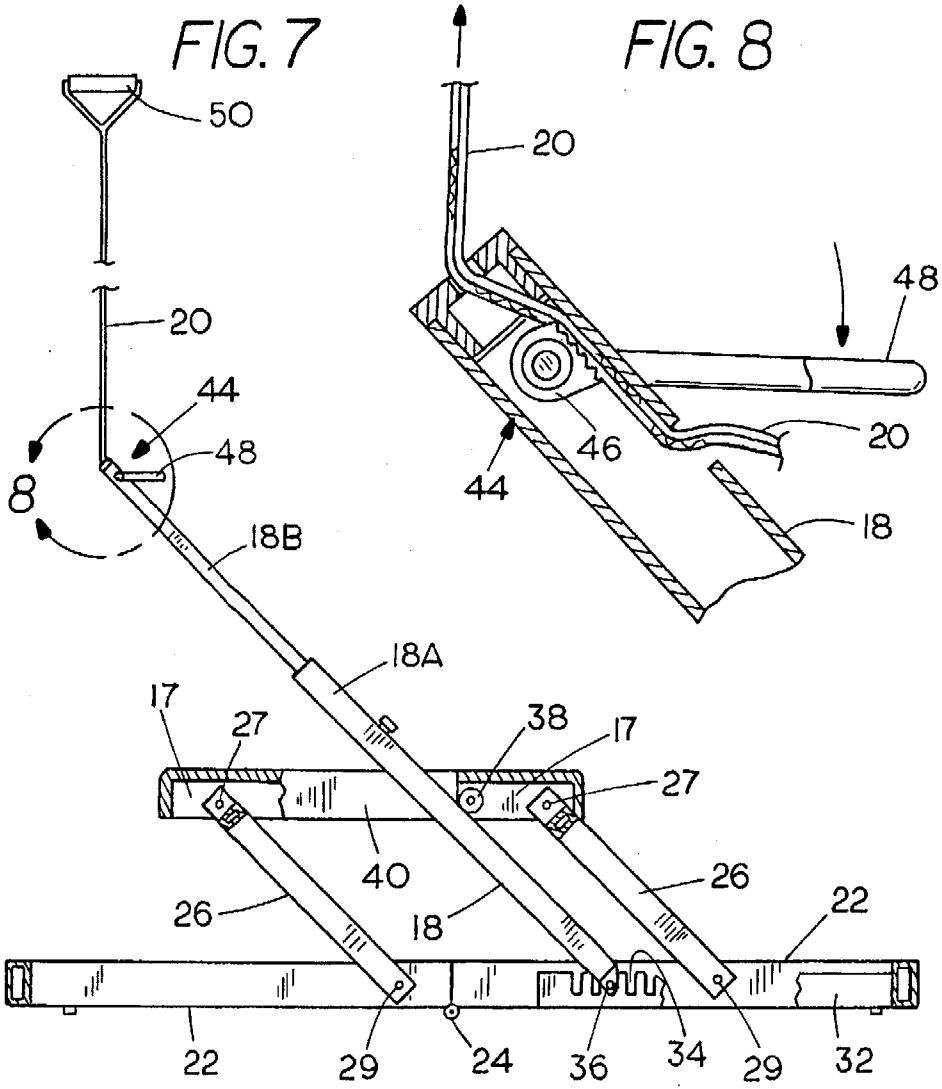
FIG. 7

PORTABLE EXERCISE DEVICE

CROSS REFERENCE TO RELATED PROVISIONAL APPLICATION

This application claims priority on provisional application Ser. No. 60/035,310, filed Jan. 13, 1997 for PORTABLE EXERCISE DEVICE.

BACKGROUND OF THE INVENTION

This invention relates generally to exercise equipment. More specifically, this invention relates to an improved exercise device of lightweight and portable construction adapted for storage in a highly compact configuration, wherein the device can be deployed quickly and easily for use in performing a variety of different exercise routines.

In the prior art, various exercising machines which utilize the weight, or partial weight, of a person exercising for loading have been advanced. Also, platforms on which a person stood for exercising have been known in the art. For example, two patents to E. A. Tuttle, No. 197,750, patented Dec. 4, 1887, and 232,217 patent Sep. 14, 1880 show platforms that are mounted on parallel links and have direct acting levers for lifting and lowering the platforms on which the person exercising stood. These devices were oriented in a manner which made adjustments somewhat difficult, and the direction of pull by the arms for lifting and loading was awkward. Further, obtaining the correct mechanical advantage for a wide range of exercising loads related to the weight of the person exercising was difficult.

A further pull type exercising device which uses a portion of the weight of a user as a resistance is shown in U.S. Pat. No. 3,446,503. This device relies on pinned levers and linkages for operation.

SUMMARY OF THE INVENTION

The present invention relates to a lightweight exercise device that in a preferred form is made for quick and easy conversion between a compact stored configuration and configuration for use in performing a variety of lifting exercises. The exercise device comprises a support platform connected to a base frame for translational, movement on an inclined path. A person stands on the support platform and lifts one end of a lift bar pivotally connected to the base and oriented to lift the support platform while the person stands thereon. The mechanical advantage of the lift bar is preferably variably selected to provide the requisite lifting force.

The base frame comprises a lightweight frame structure preferably including a pair of frame members adapted to fold between the stored and deployed configurations. Folding is not necessary for the unique function. The frame members are coupled by a guide system to the support platform. As shown parallel links are used as a guide system for the support platform. The lift bar has a pivot connection at a lower end releasably connected to the base frame and it extends upwardly and forwardly beneath the support platform. The lift bar has a front or outer end that extends forwardly from the support platform. The outer end is configured to permit a user to put up on the lift bar. As shown, a pair of lift straps are connected to the outer end of the lift bar and have handles for convenient grasping by a person standing on the platform. The lift bar will bear against the support platform when the outer end is lifted, to thereby raise the platform. A roller or other low friction bearing connector is mounted on the underside of the support platform to rollingly engage the lift bar as the bar is pivoted upwardly by the person to lift the platform.

The pivot end of the lift bar connects to the base frame at one or more pivot locations. A plurality of separate locations are shown, which permit changing the mechanical lever arm acting on the support platform and thereby change the lifting force required to lift the support platform and the weight of the standing person. A central runner or tongue fixed to the base frame extends in fore and aft direction, and the lift bar pivots on the tongue. The effective length of the lift bar lever arm acting on the support platform is changed by moving the pivot of the lift bar relative to the point of engagement of the lift bar with the support platform. Since the action is as a second class lever, with the same weight on the support platform more effort or upward load on the front end of the lever is required to lift the support platform if the pivot of the lift bar is moved rearwardly. The change of the pivot position can be done by moving the pivot pin into one of a plurality of slots in the runner or tongue, or the tongue can be telescoped relative to a mounting to change the pivot position.

The length of the lift bar, as well as the length of the lift straps can be adjusted to accommodate persons of different heights, and also to accommodate performance of a wide range of different exercise routines. After use, the device can be returned quickly and easily to the compact stored configuration for facilitated storage in a convenient out-of-the-way location, for example under a bed. The device is easily stored even if the base frame does not fold. Alternately, in the stored position, the device is suitable for travel, for example, within a compact carrying case sized for use as an in-flight carry-on bag.

BRIEF DESCRIPTION OF THE DRAWINGS

FIG. 7 is a fragmentary side elevational view similar to FIG. 6, with portions broken away to reveal component connection details;

FIG. 8 is an enlarged fragmentary sectional view corresponding generally with the encircled region 8 of FIG. 7;

FIG. 9 is a perspective view showing the device in a partially raised position and with a person exercising standing thereon;

DETAILED DESCRIPTION OF THE PREFERRED EMBODIMENTS

Figure 1:
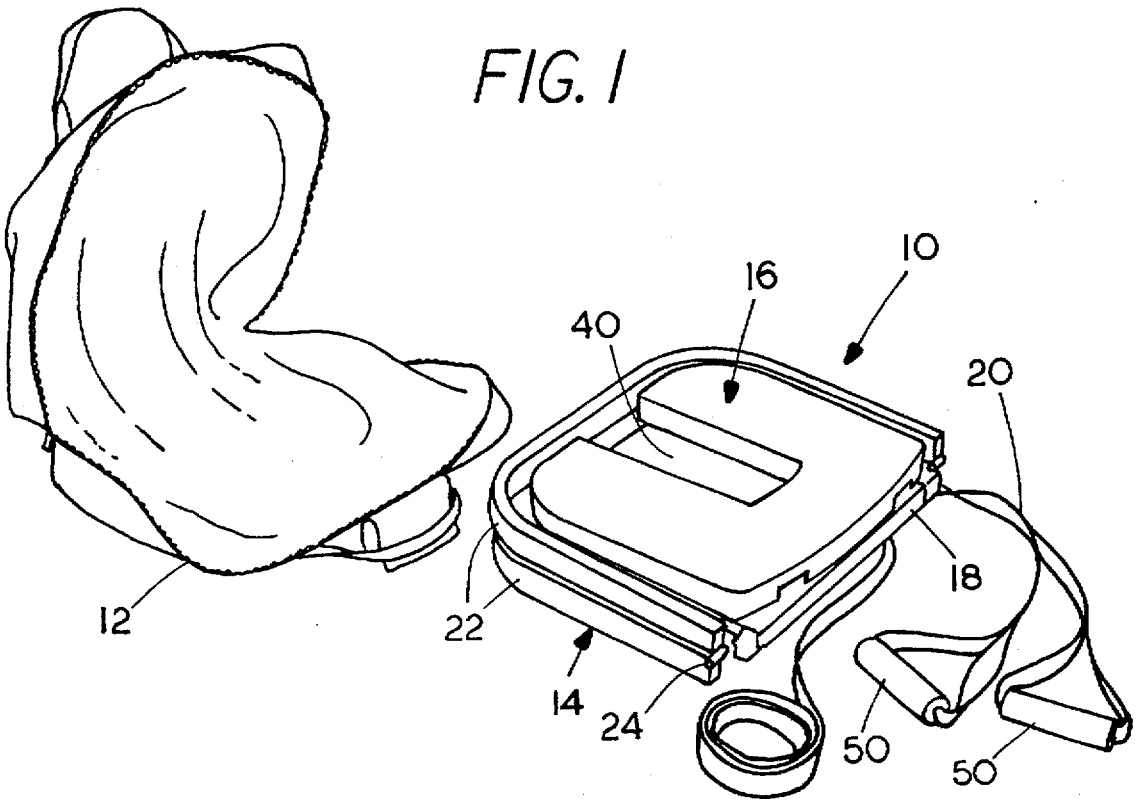
FIG. 1 is a perspective view illustrating an exercise device embodying the novel features of the invention, shown in a compact stored configuration in association with a compact carrying case.
Figure 2:
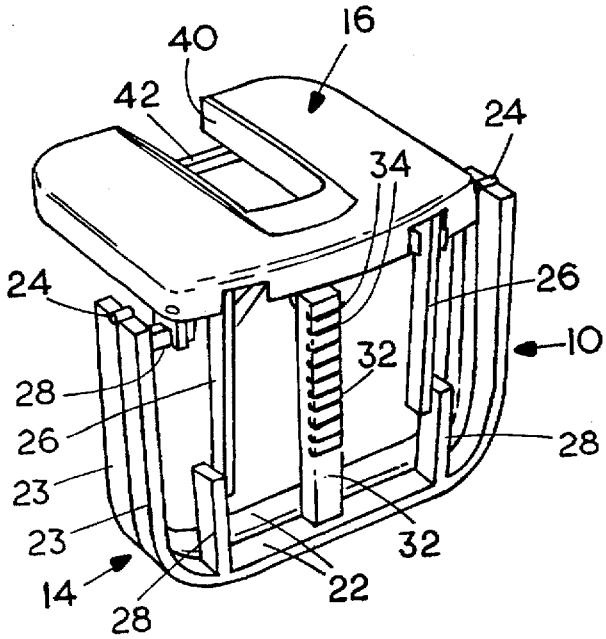
FIG. 2 is a perspective view illustrating a first step in deployment of the folding base frame.

As shown in the drawings, a portable exercise device referred to generally by the reference numeral 10 is provided for quick and easy conversion between a compact stored configuration shown in FIG. 1, and an upright deployed configuration shown in FIGS. 6–9. The exercise device 10 comprises a lightweight structure for use in performing a range of different exercise routines by lifting a person's own weight or selected proportion thereof. When not in use, the device 10 is preferably designed to collapse to the stored configuration which is highly compact and suitable for travel, for example, as an airline carry-on item.

FIG. 1 illustrates the device 10 in the stored configuration, positionable adjacent to a carrying case 12 having a size and shape to hold the device 10 for convenient travel use, if desired. The device 10 comprises a base frame 14 connected by a plurality of pivot links (not shown in FIG. 1) (a parallel linkage) to a support platform 16, in combination with a lift bar 18 which is designed to be removed from and assembled to the frame 14. When removed, the lift bar 18 will fit within the folded frame. Platform 16 is nested within the frame in the stored configuration. A lift strap 20 having two lengths 21 is connected to an outer end of the lift bar 18, and is adapted to wrap around the folded exercise device so that the entire exercise device 10 will fit easily into the case 12.

Figure 3:
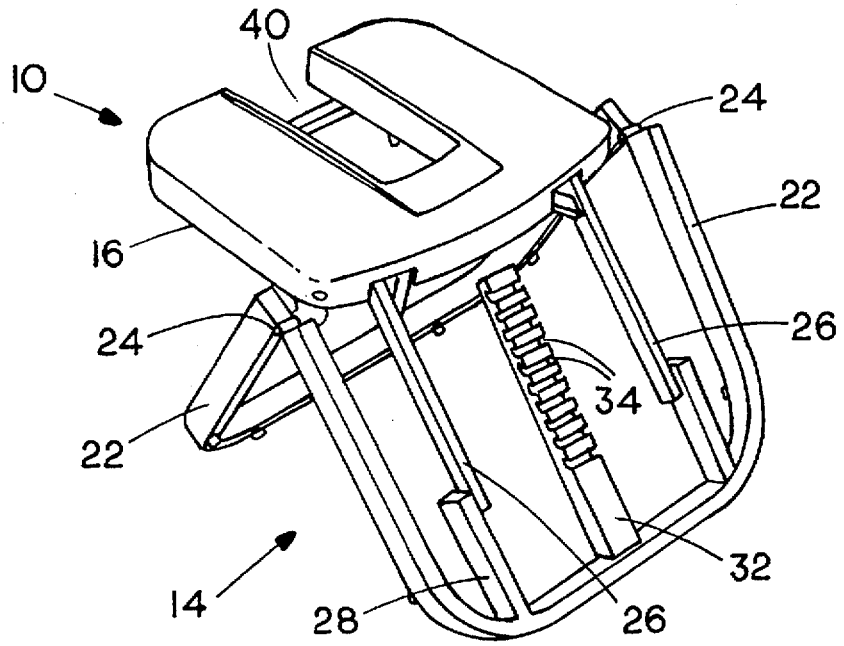
FIG. 3 is a further perspective view showing, in sequence, further movement of the base frame to a deployed configuration.

As shown in more detail in FIGS. 2–5, the base frame 14 comprises, in the first form of the invention, a pair of generally U-shaped frame members 22 formed from lightweight metal tubing or the like, and having spaced legs 23 joined with end cross members 23A. The ends of the legs 23 of one frame 22 are connected to the legs 23 of the other frame 22 by a pair of hinges 24 or pivots. The hinges 24 permit folding the frame members 22 between the stored configuration (FIGS. 1 and 2) wherein the frame members 22 directly overlie each other, and the deployed or usable configuration (FIG. 4) wherein the frame members 22 are oriented with legs 23 end-to-end and with the frames coplanar so they rest on a supporting surface. The frame may be a non folding frame if desired. FIG. 3 shows the two frame members 22 in an intermediate position partially unfolded between the stored and deployed or usable configurations.

Support platform 16 comprises a lightweight platform constructed from molded plastic or the like, and is of sufficient size to permit a person to stand thereon. The platform 16 can have underlying frame members 17 for strength as shown in FIG. 7. The support platform 16 is connected to the base frame 14 by a guide system for guiding the path of movement of the support frame. The guide system shown comprises pivot links 26. As shown, the pivot links 26 are interconnected between the frame member 17 of support platform 16 and mounting brackets 28 on the frame members 22 by appropriate pivot pins shown at 27 and 29 in FIG. 7. The support platform can be raised and lowered relative to the base frame as viewed in FIGS. 6 and 7. The path of movement is configured vertical and horizontal movement. In a preferred embodiment, four of the pivot links 26 are provided, two on each side of the base frame 14 to form a parallel linkage so that the support platform 16 remains oriented in space as it moves between the raised and lowered-positions.

Figure 4:
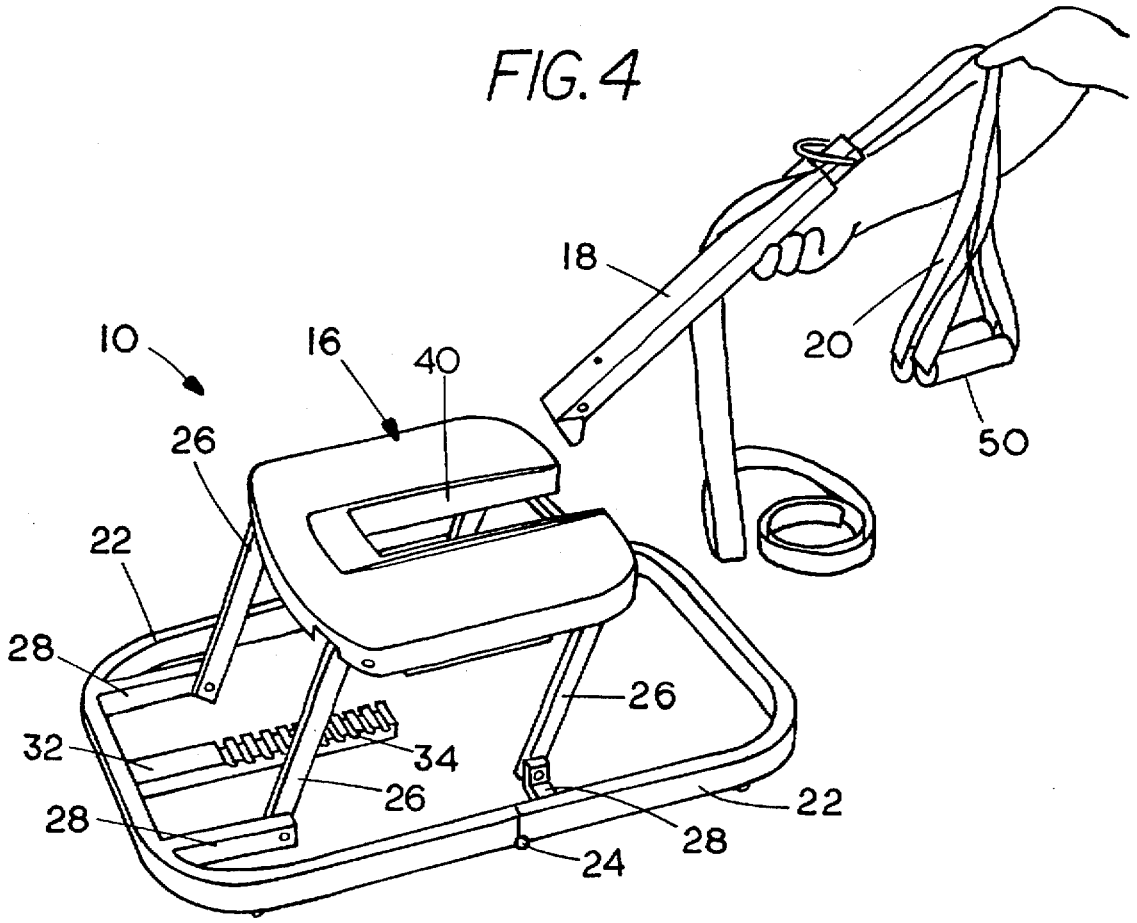
FIG. 4 is a further exploded perspective view showing reassembly of the lift bar with the base frame.

The lift bar 18 is designed for removable mounting onto the base frame 14, as shown in FIG. 4. In the stored configuration, the hinged end of the folded frame members 22 defines a shallow pocket for convenient nested reception of the lift bar 18. Pins on one of the frame members 22 that engage the bar can provide a simple and convenient structure for retaining the lift bar in its stored position. When it is desirable to erect the exercise device 10 to the deployed configuration, the lift bar 18 is quickly and easily removed from the base frame 14. Removal of the lift bar 18 permits the support platform 16 to be pivoted from its normal stored position overlying the folded base frames 22 (FIG. 2) to correspondingly permit unfolding of the base frames 22 as shown in FIG. 3.

Figure 5:
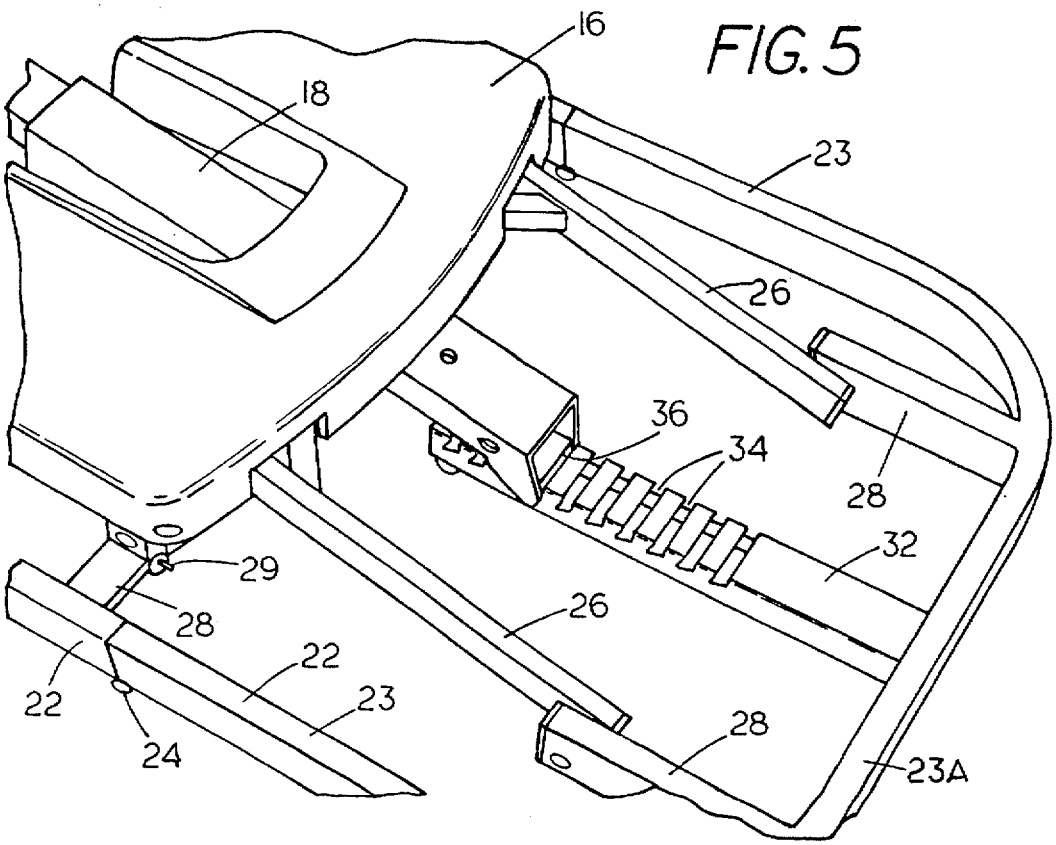
FIG. 5 is an enlarged fragmentary perspective view showing interconnection between the lift bar and the base frame.
Figure 6:
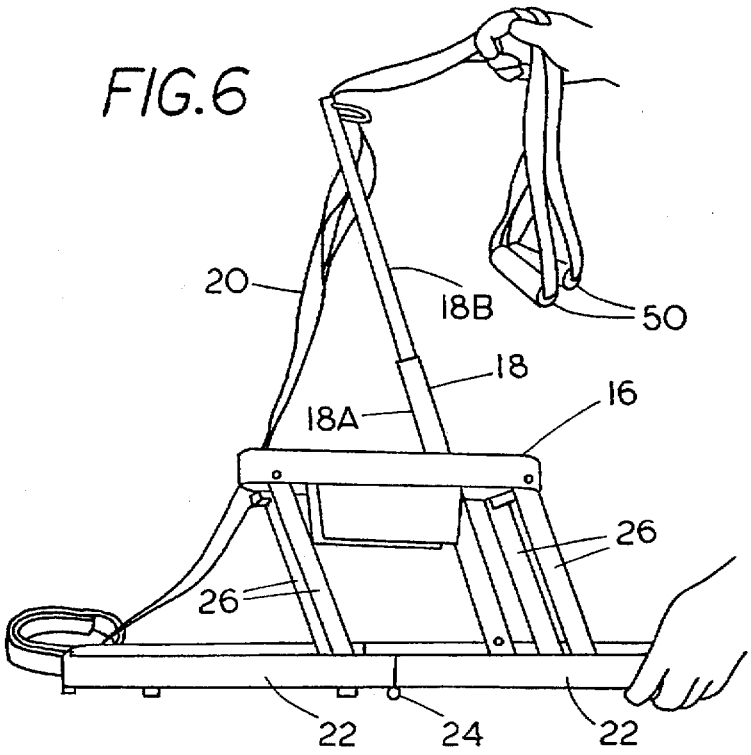
FIG. 6 is a side elevational view illustrating the exercise device in the deployed configuration.

With the base frame 14 in the deployed or usable condition, the lift bar 18 is quickly and easily re-assembled as shown in FIGS. 4–6. More particularly, the rearward one of the base frames 22 includes a forwardly extending central runner or tongue 32 having a plurality of cross recesses 34 formed therein at positions spaced apart in a fore and aft direction. These recesses 34 are sized and shaped to receive a connector pin 36 (FIG. 5) carried at a rear end of the lift bar 18. The lift bar 18 is assembled with the tongue 32, with the connector pin 36 seated within a selected one of the recesses 34. As shown best in FIG. 5, the recesses 34 are desirably formed with a small retaining notch that will tend to hold the pivot pin 36 in position in the respective groove.

The lift bar 18 extends angularly upwardly and forwardly from the central tongue 32 beneath the support platform 16 bearing against and in rolling contact with a roller 38 (FIG. 7) rotatably mounted on frame members on the underside of the platform 16. The lift bar 18 extends farther forwardly through a central cavity or slot 40 that bifurcates the forward end of the support platform. The roller 36 is at the base or closed end of the slot 40. The lift bar 18 extends out over a forward cross bar 42 on the front U-shaped frame member 22. The lift bar 18 is made in two sections 18A and 18B that are telescopically adjustable in length with a series of holes and a spring loaded detent pin to hold the section in a desired position. The lift strap 20 is connected to a forward end of the lift bar. The lift strap 20 is in turn adjustable in length by means of a spring loaded ratchet mechanism 44 (FIG. 8), wherein the strap length can be increased or decreased by depressing a handle or spring release lever 48 to release a pawl 46 by pivoting it away from a wall of the lift bar 18. When the handle 48 is released the pawl 46 pivots to clamp the strap against the inner surface of the lift bar 18. As tension is applied to the outer end of strap 20 the pawl will tighten to hold the strap in position. The strap lengths 23 have handles 50 on their free ends. The outer end of the lift bar can be configured for gripping by a user in any desired manner.

In use, with the device 10 in the fully deployed or usable configuration as shown in FIGS. 5–7 and 9–11, a person or user 52 can stand on the support platform 16 with the forwardly projecting lift bar 18 disposed between the person's feet. In this geometry, with the lift bar 18 and strap 20 adjusted to a desired length, the person 52 can grasp the handles 50 and lift upwardly. This lifting motion effectively raises the lift bar 18, which engages the roller 38 on the support platform 16 to lift the support platform 16 upwardly (and laterally or horizontally) relative to the base frame 14 as guided by the parallel links 26, thereby lifting the person standing on the platform. FIG. 9 shows this lifting action, depicting the person 52 standing on the support platform 16 which has been partially lifted by the person. It can be moved to a fully raised position as shown in FIG. 6. The lifting force required for this purpose is adjustably selected by positioning the connector pin 36 in a selected one of the tongue recesses 34. Such adjustable positioning of the connection point between the lift bar 18 and the base frame changes the mechanical moment arm to correspondingly select the required lifting force on straps 20 with the same weight on the platform. In addition, it will be noted that the effective length of this moment arm acting on roller 38 progressively decreases through a single upward lifting stroke, whereby the lifting force required progressively increases through the upward stroke.

The exercise device 10 is extremely versatile in that a wide range of different exercise routines can be performed to exercise different muscles and muscle groups. The lengths of the lift bar 18 and strap 20 can be varied through a wide range of adjustment positions for this purpose, in combination with the person 52 standing on the support platform which has been orientations facing forwardly, rearwardly, etc. After use, the device 10 can be returned quickly and easily to the compact stored configuration, for storage and/or transport to a different location for use.

A wide variety of modifications to the portable exercise device of the present invention will be apparent to persons skilled in the art.

Figure 10:
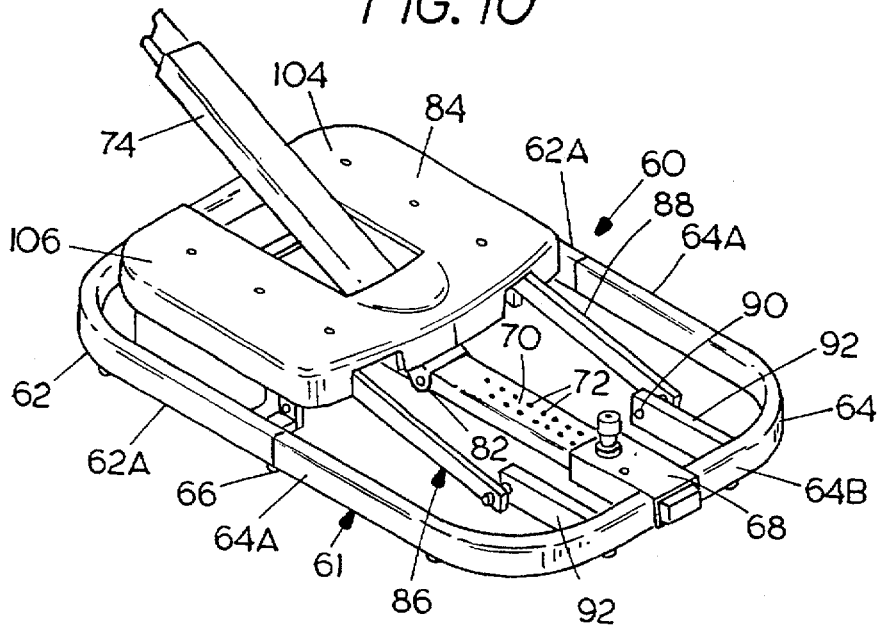
FIG. 10 is a perspective view of a second form of the invention, shown in a collapsed position.
Figure 11:
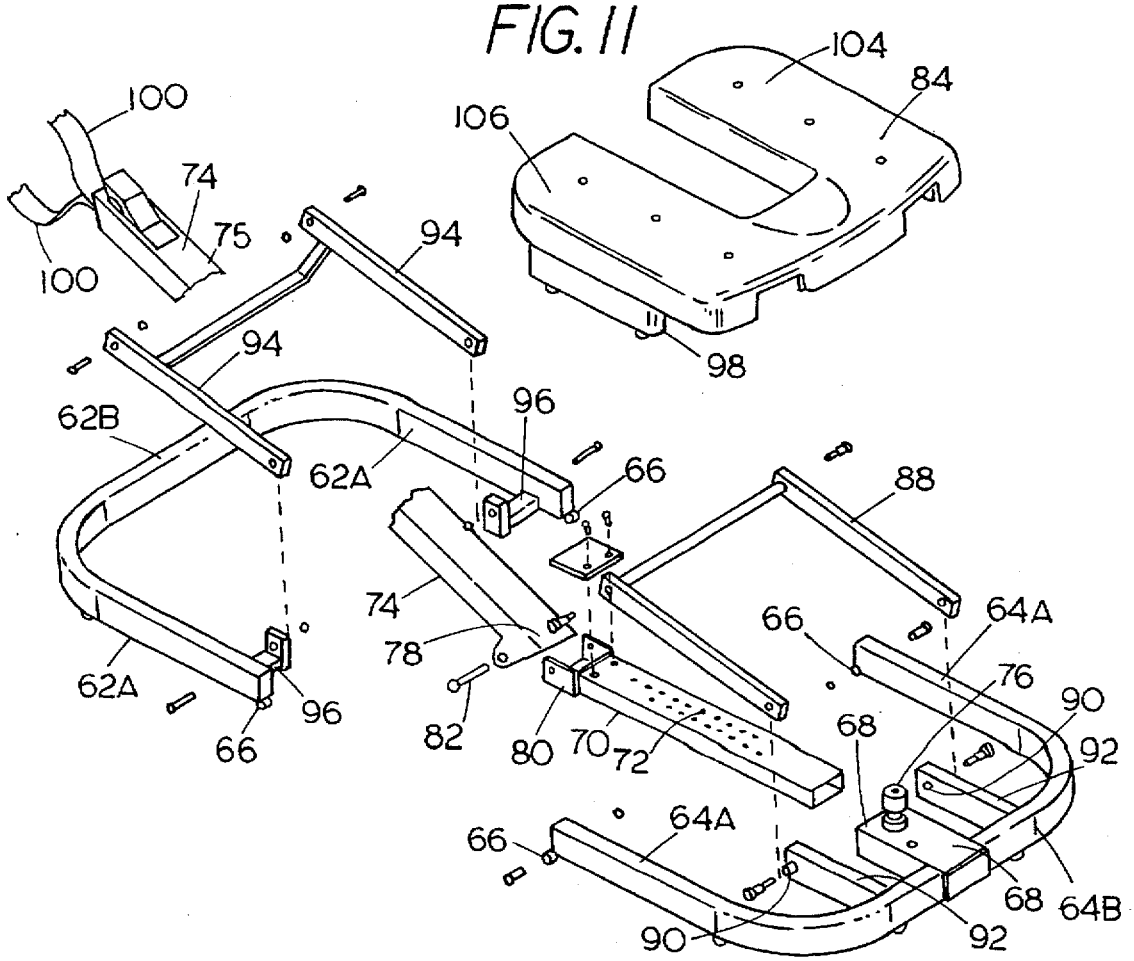
FIG. 11 is an exploded view of the second form of the invention.
Figure 12:
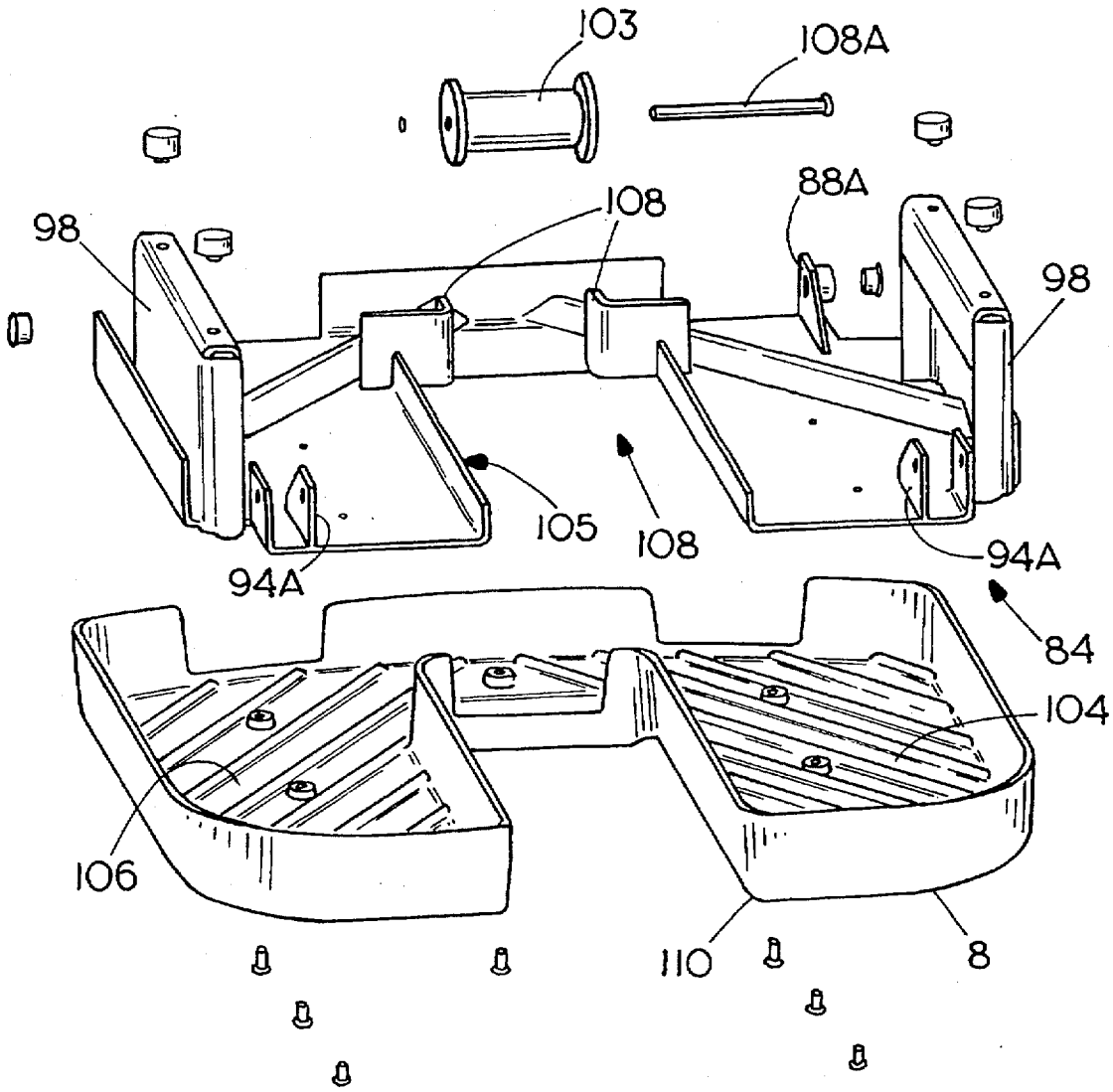
FIG. 12 is an exploded view of a support platform shown in FIG. 11 with the platform inverted.

A preferred second embodiment of the present exerciser is shown in FIGS. 10 through 12. The operational concepts are the same as that shown in the first form of the invention. The exercising device 60 has a base frame or support 61 which includes a first front U-shaped frame 62 and a second rear frame 64 which has legs 64A that align with the legs 62A of the first U-shaped frame 62 and are preferably connected with hinges or pivots 66, but the base support 61 may be a fixed, non folding frame. The rear U-shaped frame as a cross member 64B forming part of the base support 61 is provided with a centered sleeve 68 that extends forwardly between the legs 66A of the U-shaped frame 64, and is of size to slidably receive a tongue 70 that has a series of adjustment holes 72 thereon. The tongue 70 forms the pivot support for a lift bar shown fragmentarily in FIGS. 10 and 11 at 74. A spring loaded pin 76 in the sleeve 68 can be lifted to permit the tongue 70 to be slid to a desired adjusted position and then the spring loaded pin 76 can be released to snap into one of the holes 72 to hold the tongue in position.

The lift bar 74 in this form of the invention also can be telescoping as shown in FIGS. 1–9. It has a saddle shaped end 78 that has legs that fit over a pivot support housing 80 on the end of the tongue 70. A removable pin 82 can be slid through provided openings in the housing 80 the legs of the end 78 to pivotally mount the lift bar 74 to the pivot support 80 and thus to the tongue 70.

A support platform 84 is mounted on a guide system, comprising a pivoting parallel linkage shown generally at 86 that includes rear links 88 on opposite sides of the frame 82 that are pivotally mounted as at 90 to short arms 92 that extend outwardly from the base of the U-shaped frame 64 on opposite sides of the sleeve 68. Forward links 94 have ends pivotally mounted to the frame 62 on supports 96. The opposite ends of the links 88 and 94 are pivotally connected to the support platform 84 at supports 88A and 94A shown in FIG. 12.

The support platform 84 has downwardly depending support blocks 98 on opposite sides thereof that are of size so that they will engage a supporting surface on which the base frame 61 is supported, and keep the support platform 84 spaced upwardly from the support surface to clear frame 61 in the collapsed or start position.

The lift straps shown at 100 are essentially the same as those shown in the previous form of the invention and can be attached to the telescoping inner section 75 of the lift bar 74 as desired. The telescoping action for the lift bar can take any desired form, to permit adjusting the length of the lift bar 74. The lift bar 74 can be adjusted as to its pivot position and thus adjust the effective lever arm acting on the support platform by telescoping the tongue 70 relative to the sleeve 68. The lift bar extends upwardly through a slot 102 that forms a bifurcation of the support platform 84 so that there are two foot supports 104 and 106 on opposite sides of the slot 102. As shown in FIG. 12 the lift bar 74 operates against a roller or rollers 103 rotatably mounted in brackets 108 a frame 105 with a pin 108A on the bottom side of the support platform 84 at the end of the slot 102. A low friction slider can be used in place of a roller is desired. The lift bar translates relative to the support platform as the parts move.

The frame 105 provides structural support and a cover 110 is used over the frame to provide a smooth appearance and also provide a suitable support surface for the foot supports 104 and 106.

The person standing on the foot supports 104 and 106 can then lift the lift bar 74 to engage roller 103 and swing the support platform 84 upwardly as guided by the parallel linkages 86. The amount of force required can be changed for each person, and can be changed easily during an exercise routine if one wants to start out with a high mechanical advantage and decrease the mechanical advantage so that a greater force is required as the exercise program proceeds.

The second form of the invention will also fold into a storage position, and if the base frame folds, it can be placed in a carrying case if desired.

The parallel links shown as a guide system can be replaced, particularly if folding to a compact position is not a factor, with other guides, such as inclined tracks receiving rollers on the sides of the user support frame. Other types of supports also can be used if desired. Further, the pivoting bar can be coupled to the support platform through a connection, such as a cable mounted on sheaves that acts to lift the support platform and the user.

Although the present invention has been described with reference to preferred embodiments, workers skilled in the art will recognize that changes may be made in form and detail without departing from the spirit and scope of the invention.

What is claimed is:

1. An exercise device comprising a base frame; a support platform for supporting a person exercising; a pivoting linkage connecting the base frame to the support platform; and a lift bar pivotally mounted to the base and movably engaging the support platform, said lift bar being movable at an end opposite from its pivotal mounting to pivot and to lift the support platform as guided by the pivoting linkage; wherein said guide comprises a pivoting linkage pivotally connected to the base frame and support platform.

2. The exerciser device of claim 1, wherein said pivoting linkage comprises at least two links that are positioned beneath the support platform and spaced in a fore and aft direction and extend to the base frame, such that the support platform is above the connection of the links to the base frame in a raised position.

3. The exercise device of claim 1, wherein said support platform is bifurcated, to form a slot open at a forward edge thereof, and wherein the slot has an inner edge portion forming a surface generally parallel to the axis of pivoting of the lift bar, a roller mounted on the support platform adjacent said inner edge portion, said lift bar engaging said roller as the lift bar is pivoted upwardly to raise the support platform.

4. The exercise device of claim 1, wherein the pivot of the lift bar is adjustable in a fore and aft direction relative to the base frame.

5. The exercise device of claim 1, wherein said lift bar has a pair of extension straps extending from a forward end thereof, said extension straps having hand grips thereon for a user of the exercise device.

6. The exercise device of claim 5, wherein said straps are adjustably mounted on an outer end of the lift bar.

7. The exercise device of claim 1 and stop blocks on a bottom surface of said support platform to engage a support surface supporting the base frame and stop the movement of the support platform toward the support surface at a desired position.

8. The exercise device of claim 1, wherein said base frame has spaced apart side members, and said lift bar is pivotally mounted between said side members.

9. The exercise device of claim 8, wherein said lift bar is pivotally mounted onto a tongue extending between said base frame side members from a rear portion thereof forwardly, and the pivot of the lift bar being adjustable in a longitudinal direction of the tongue.

10. The exercise device of claim 9, wherein said tongue has a series of selectable adjustment openings for permitting adjustment of the pivot of the lift bar.

11. The exercise device of claim 9, wherein said lift bar is removably pivotally mounted to said tongue.

12. An exerciser in which the weight of the user provides a resistance to movement, comprising a base frame, a user support configured to support a user, a support linkage mounting the user support relative to the base frame, said support linkage guiding movement of the user support from a lowered position along a vertical and horizontal translating path to a raised position, a lift bar pivotally mounted relative to said base frame and operably connected to the user support at a location spaced from the pivotal mounting thereof whereby pivotal movement of said lift bar moves said user support as guided by said support linkage between the raised and lowered positions, and an outer end of said lift bar being configured to permit a user to stand on the user support pivotally move the lift bar; wherein said lift bar is operably connected to said user support by directly bearing on a portion of said user support and exerting loads tending to move said user support on said support linkage; and a roller rotatably mounted on said user support against which said lift bar directly bears, said roller rolling along the lift bar as the lift bar is pivotally moved by the user.

13. The exerciser of claim 12, wherein said lift bar is pivoted to said base frame about a pivot axis which is positioned adjacent one end of the base frame, said lift bar extending toward and overlying an opposite end of said base frame, and the roller engaging the lift bar in intermediate portions of said lift bar.

14. The exerciser of claim 12, wherein the support linkage is a pivoting four bar linkage.

15. The exerciser of claim 14, wherein the pivotal mounting of the lift bar is adjustable relative to pivot axes of the four bar linkage.

16. The exerciser of claim 12, wherein said user support overlies said lift bar in its lowered position, and wherein as the lift bar is pivoted to raise the user support, the roller moves closer to a generally vertical plane passing through the pivotal movement of the lift bar to the base frame.

17. An exerciser device that is self energizing by the weight of the user comprising a base frame, a user support, a guide assembly on the base frame configured to guide said user support for movement from a first position wherein the user support is adjacent the base frame to a second raised position wherein the user support is spaced above said base frame guide assembly guiding the user support on a combined upwardly and horizontally inclined path between the first and second position, and said user support overlying said guide assemblies in the first position, a lift bar pivotally mounted on said base frame and having a longitudinal axis that extends substantially midway between a first pair of guide members forming part of the guide assembly on a first side of the base frame and a second pair of guide members of the guide assembly on a second side of said base frame, said pivot of said lift bar being positioned such that when an end of the lift bar opposite from the pivot of the lift bar is raised, the lift bar engages a portion of the user support and causes the user support to be lifted from its lowered position as guided by the parallel links.

18. The exerciser of claim 16, wherein the guide assembly comprises a pivot linkage, the first and second guide members comprising pairs of parallel linkage pivotally mounted to the base and pivotally mounted to the user support frame.

* * * * *